US006212829B1

(12) United States Patent
Webb et al.

(10) Patent No.: US 6,212,829 B1
(45) Date of Patent: Apr. 10, 2001

(54) COPING ASSEMBLY FOR BUILDING ROOF

(75) Inventors: William C. Webb, Fletcher; Neil Tedder, Asheville; Christopher K. McCoy, Candler; David McKinney, Weaverville, all of NC (US)

(73) Assignee: W. P. Hickman Company, Asheville, NC (US)

( * ) Notice: Subject to any disclaimer, the term of this patent is extended or adjusted under 35 U.S.C. 154(b) by 0 days.

(21) Appl. No.: 09/544,409

(22) Filed: Apr. 6, 2000

(51) Int. Cl.[7] ..... E04F 19/02
(52) U.S. Cl. ..... 52/96; 52/60
(58) Field of Search ..... 52/58, 60, 94, 52/96, 300

(56) References Cited

U.S. PATENT DOCUMENTS

| | | | |
|---|---|---|---|
| Re. 28,870 | | 6/1976 | Attaway et al. . |
| 1,337,840 | | 4/1920 | Hawley . |
| 1,740,753 | | 12/1929 | Vallas . |
| 1,782,246 | | 11/1930 | Schneider . |
| 2,123,967 | * | 7/1938 | Richter ..... 52/96 |
| 2,554,779 | | 5/1951 | Goodwin . |
| 2,734,602 | | 2/1956 | Dawson . |
| 2,855,776 | | 10/1958 | Trostle . |
| 3,012,376 | | 12/1961 | Reddy et al. . |
| 3,034,573 | | 3/1962 | McKinley . |
| 3,187,464 | | 6/1965 | Sharp . |
| 3,237,352 | | 3/1966 | Edwards . |
| 3,404,495 | | 10/1968 | Simpson, Jr. . |
| 3,405,485 | | 10/1968 | Edwards . |
| 3,447,273 | | 6/1969 | Thom . |
| 3,503,162 | | 3/1970 | Ward . |
| 3,634,984 | | 1/1972 | Murphy . |
| 3,668,811 | | 6/1972 | Pollard . |
| 3,719,010 | | 3/1973 | Hickman . |
| 3,802,140 | | 4/1974 | Hickman . |
| 3,862,531 | | 1/1975 | Attaway et al. . |
| 4,009,548 | | 3/1977 | Hicks . |
| 4,071,987 | | 2/1978 | Hickman . |
| 4,083,158 | | 4/1978 | Wolma . |
| 4,155,203 | | 5/1979 | Wolma . |

(List continued on next page.)

OTHER PUBLICATIONS

MM Systems "Snap–lok Coping" (1 page) 1984.
Hickman Permasnap® Coping (1 page) circa. 1974.
Extruded Aluminum Gravel Stops and Copings (2 pages) date unknown.
Construction Specialties C/S Colortrim Coping (2 pages) date unknown.
Trion "Architectural Copings" (1 page) date unknown.
Metal–Era Inc. "Full Coping" (1 page) 1981.
Overly Manufacturing Company "Overly Metal Coping" (4 pages) 1965.
Hickman "Permasnap Coping Controls Water With Unique Gutter/Chair" (1 page) 1982.
Hickman "Formed Products" (1 page) 1986.
MM Systems Catalog pages (4 pages) 1997.
Hickman "The Slimline Fascia/Cap That's An Engineered Parapet Wall" (1 page) 1980.

*Primary Examiner*—Richard Chilcot
(74) *Attorney, Agent, or Firm*—Harness, Dickey & Pierce, P.L.C.

(57) ABSTRACT

A coping assembly for a parapet wall, cant dam or gravel stop resiliently maintains the coping assembly in a tight-fitting interlocking installation and has a locator member beneath the coping cap or cover for maintaining at least a portion of the outer coping cap in a predetermined cross-sectional shape and in an accurate alignment between adjacent sections of the coping cap. The preferred locator member is generally symmetrical with respect to a line normal to the face of the wall, dam stop or other raised roof protrusion. The coping assembly is quicker, easier, and less costly to install than prior such structures and provides enhanced protection for interior or underlying components or structures.

53 Claims, 12 Drawing Sheets

U.S. PATENT DOCUMENTS

| | | | | |
|---|---|---|---|---|
| 4,155,206 | | 5/1979 | Player . | |
| 4,404,777 | | 9/1983 | Lolley et al. . | |
| 4,419,850 | | 12/1983 | Butzen . | |
| 4,439,956 | | 4/1984 | House . | |
| 4,472,913 | | 9/1984 | Hickman . | |
| 4,483,112 | | 11/1984 | Rueblinger . | |
| 4,488,384 | | 12/1984 | Hickman . | |
| 4,549,376 | | 10/1985 | Hickman . | |
| 4,550,535 | | 11/1985 | Drogosch . | |
| 4,586,301 | | 5/1986 | Hickman . | |
| 4,592,176 | | 6/1986 | van Herpen . | |
| 4,598,507 | | 7/1986 | Hickman . | |
| 4,641,476 | | 2/1987 | Webb et al. . | |
| 4,662,129 | | 5/1987 | Hickman . | |
| 4,780,999 | | 11/1988 | Webb et al. . | |
| 4,858,406 | | 8/1989 | Lane et al. . | |
| 4,890,426 | | 1/1990 | Hickman et al. . | |
| 4,909,006 | | 3/1990 | Hickman et al. . | |
| 4,964,248 | | 10/1990 | Braine et al. . | |
| 4,969,250 | | 11/1990 | Hickman et al. . | |
| 4,970,832 | | 11/1990 | van Herpen . | |
| 5,848,435 | * | 12/1998 | Knudson | 52/96 X |
| 5,893,247 | * | 4/1999 | Hickman et al. | 52/60 X |

* cited by examiner

COPING ASSEMBLY FOR BUILDING ROOF

BACKGROUND AND SUMMARY OF THE INVENTION

The present invention relates generally to coping, cover or cap assemblies for covering a parapet wall, cant dam, gravel stop, or other raised upward protrusion extending along the edge or other area of a building roof, as well as to free-standing or other types of walls. More specifically, the present invention relates to such coping assemblies having arrangements for resiliently maintaining the coping assembly in a tight-fitting installation and having a locator member for maintaining at least a portion of the outer coping cap in a predetermined cross-sectional shape and accurately aligned between adjacent sections of the coping cap.

Various coping, cap or cover assemblies for free-standing walls, parapet walls, cant dams, gravel stops, or other such raised protrusions from a building roof have long been provided in the prior art. However, most of such prior coping assemblies have suffered from the same disadvantages of being relatively time-consuming, difficult and costly to install, as well as often being unacceptably misaligned at joints between adjacent end-to-end coping or cover sections. Such misalignment is not only unattractive aesthetically, but it can also result in unacceptable amounts of wind or water being admitted to the interior of the coping assembly structures, thus exposing the structures as well as the walls, cants or stops to potential damage. In addition, many of such prior coping arrangements have lacked a sufficiently tight-fitting installation such that sagging or rattling can occur.

Accordingly, the present invention seeks to overcome the above-mentioned disadvantages of the prior art coping or cover systems by providing a coping, cap or cover, and its underlying structure, that is quicker, easier, and less costly to install. In addition, the present invention provides a tight-fitting assembly with greatly improved alignment between adjacent coping cap or cover sections resulting in a smoother and more pleasing aesthetic appearance, as well as enhanced protection for interior or underlying components or structures.

A coping assembly according to the present invention preferably includes a coping cleat for fixed securement to a raised protrusion, either free-standing or protruding from the building roof, having an upper protrusion surface, an outer protrusion face extending generally downwardly from one side of the upper protrusion surface and an inner protrusion face extending generally downwardly from an opposite, inner side of the upper protrusion face. The coping cleat preferably includes an upper cleat portion extending along or adjacent to the protrusion's upper surface, an outer cleat portion extending downwardly at or adjacent the outer protrusion face from an outer side of the upper cleat portion, and an inner cleat portion extending generally downwardly along or adjacent to the inner protrusion face from an opposite, inner side of the upper cleat portion. A coping cover or cap has an upper cap portion, an outer cap portion extending generally downwardly from an outer side of the upper cap portion and an inner cap portion extending generally downwardly from an opposite, inner side of the upper cap portion. The outer and inner cap portions are secured to the respective outer and inner cleat portions, preferably by way of generally hook-shaped cap portion edges that allow for snap-on installation onto the outer and inner cleat portions.

A spring clip is secured to the coping cleat and is disposed between the coping cleat and at least a portion of the coping cap, with the spring clip having at least one resilient spring clip protrusion resiliently engaging a portion of the underside of the coping cap for maintaining a resiliently-biased tight-fitting assembly. A coping locator is also provided and is preferably secured to the coping cleat between the coping cleat and the coping cap. The coping locator protrudes from the coping cleat to engage a portion of the underside of the coping cap in order to space such portion of the coping cap a predetermined, generally fixed distance from the coping cleat. The locator also maintains at least a portion of the coping cap in a predetermined cross-sectional shape.

Such coping cleats and coping caps according to the present invention are typically in longitudinally-extending sections of the predetermined length. In installations where more than one section is required, the coping cap sections serially and abuttingly engage one another along the raised protrusion on the building roof. In such installations, the present invention provides a joint cover disposed between the underside of adjacent coping cap sections and the coping locator at the abutting engagement of adjacent coping cap sections. The joint cover is preferably of substantially the same lateral cross-sectional configuration as the coping cap. Thus the coping locator, which is preferably of a configuration that is symmetrical with respect to a line normal to the adjacent surface of the raised roof protrusion, provides additional strength for the joint as well as working in conjunction with the joint cover to maintain the abutting ends of the adjacent coping cap sections in proper alignment with one another and to minimize entrainment of wind or water.

Although the various components of the embodiments described below are preferably fabricated of sheet metal, such as galvanized steel, for example, other sheet or even molded materials can also be used. Also, the tab-locking arrangements discussed below are generally interchangeable with driven or threaded fasteners or various welding attachments.

Additional objects, advantages, and features of the present invention will become apparent from the following description and the appended claims, taken in conjunction with the accompanying drawings.

DETAILED DESCRIPTION OF THE PREFERRED EMBODIMENTS

Figure 1:
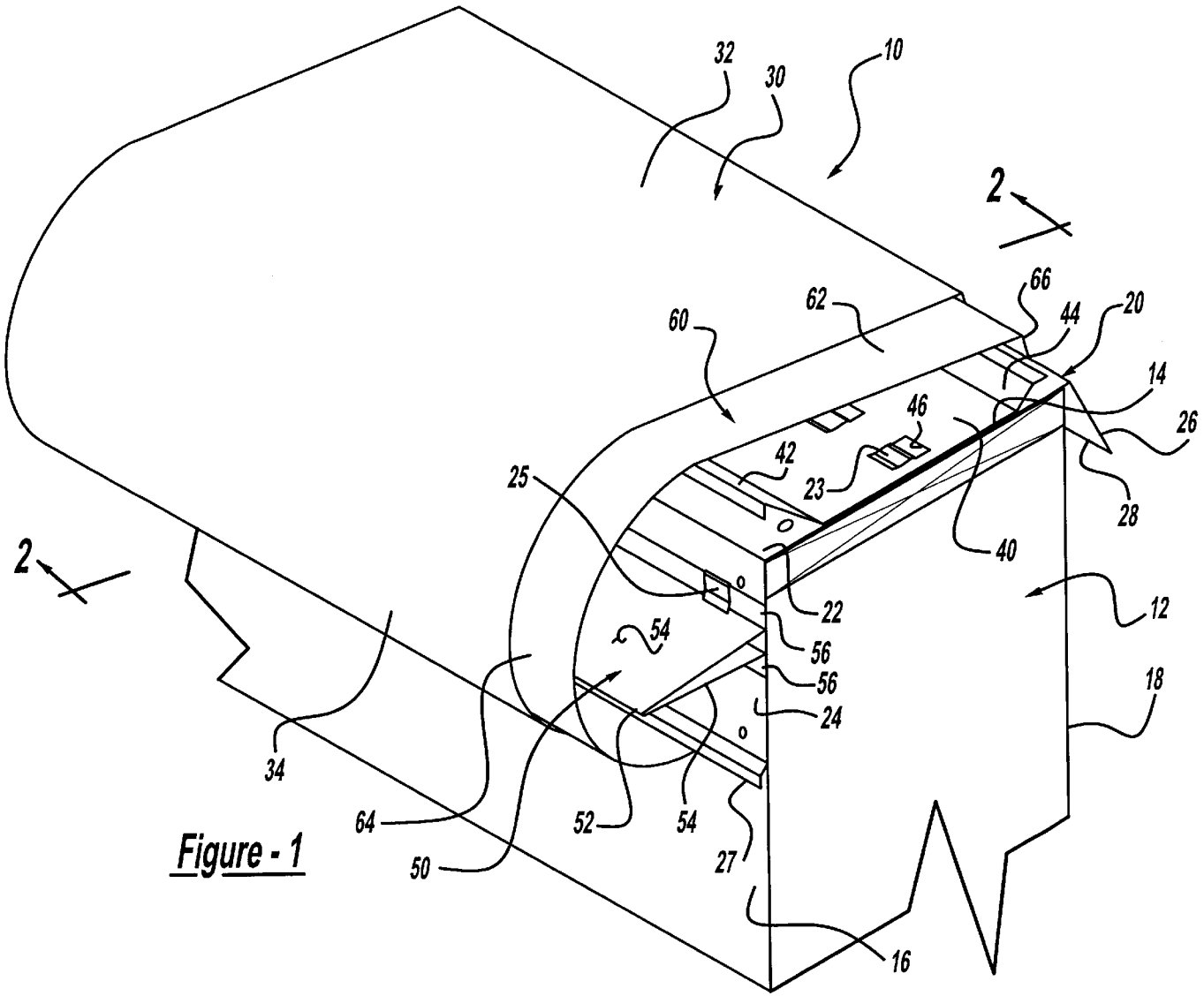
FIG. 1 is a partial, detailed perspective view of a portion of a coping assembly according to the present invention installed upon an exemplary parapet wall.
Figure 2:
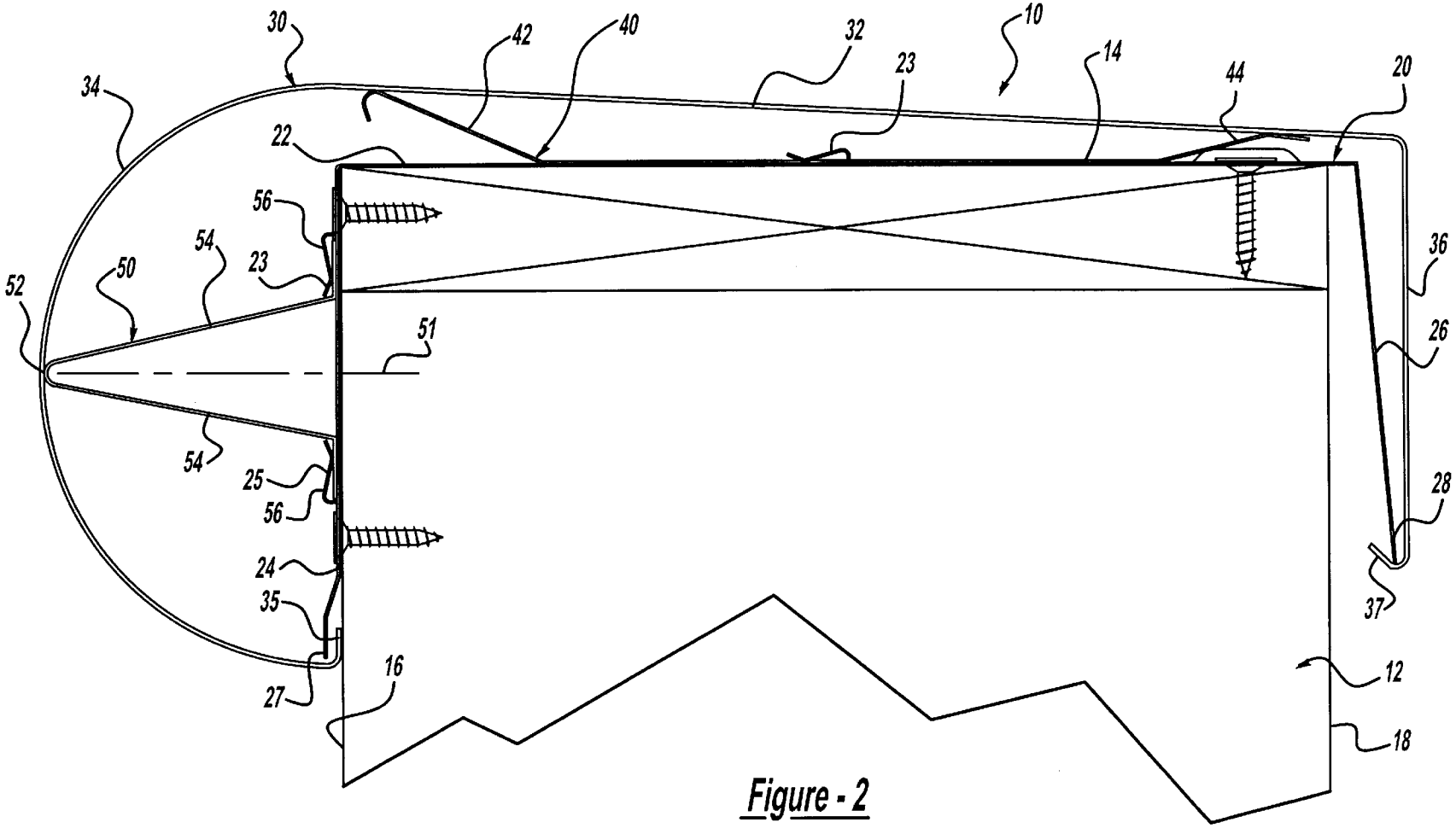
FIG. 2 is a lateral cross-sectional view, taken generally along line 2–2 of FIG. 1.
Figure 3:
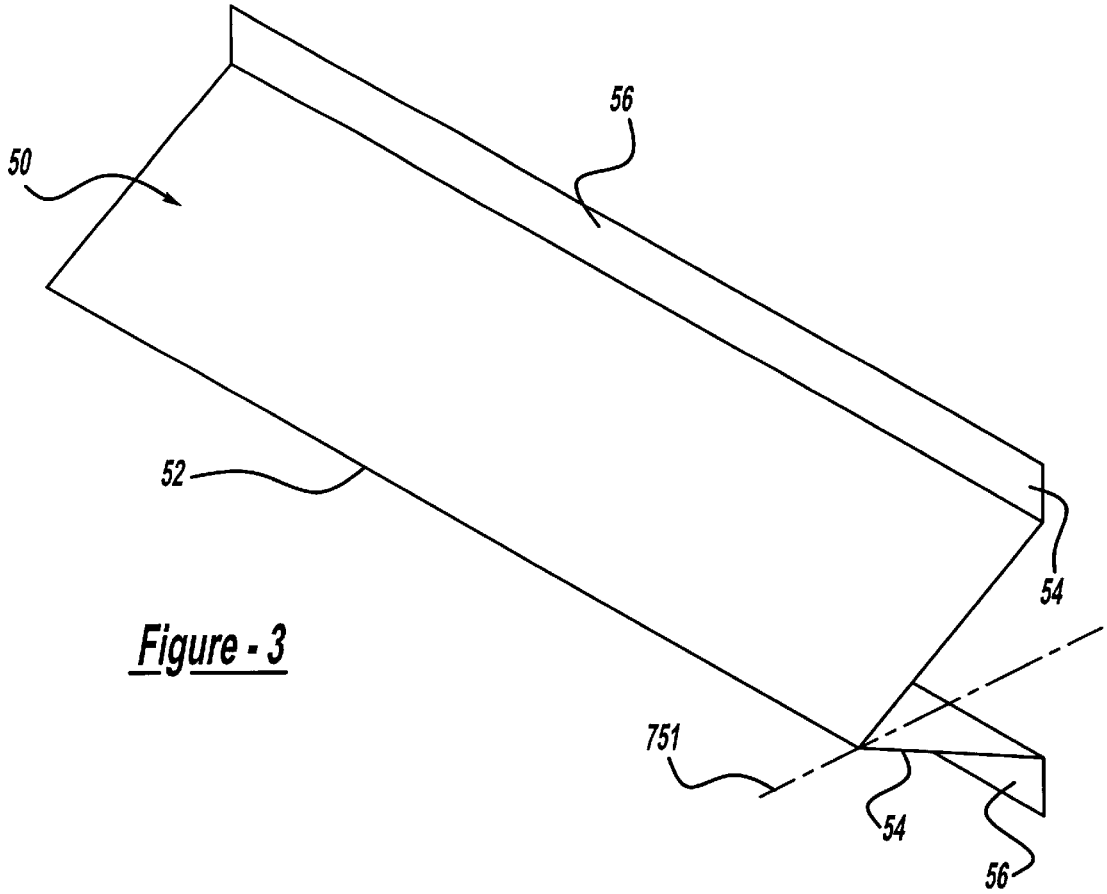
FIG. 3 is a perspective view of a portion of the coping cap locator member of FIGS. 1 and 2.
Figure 4:
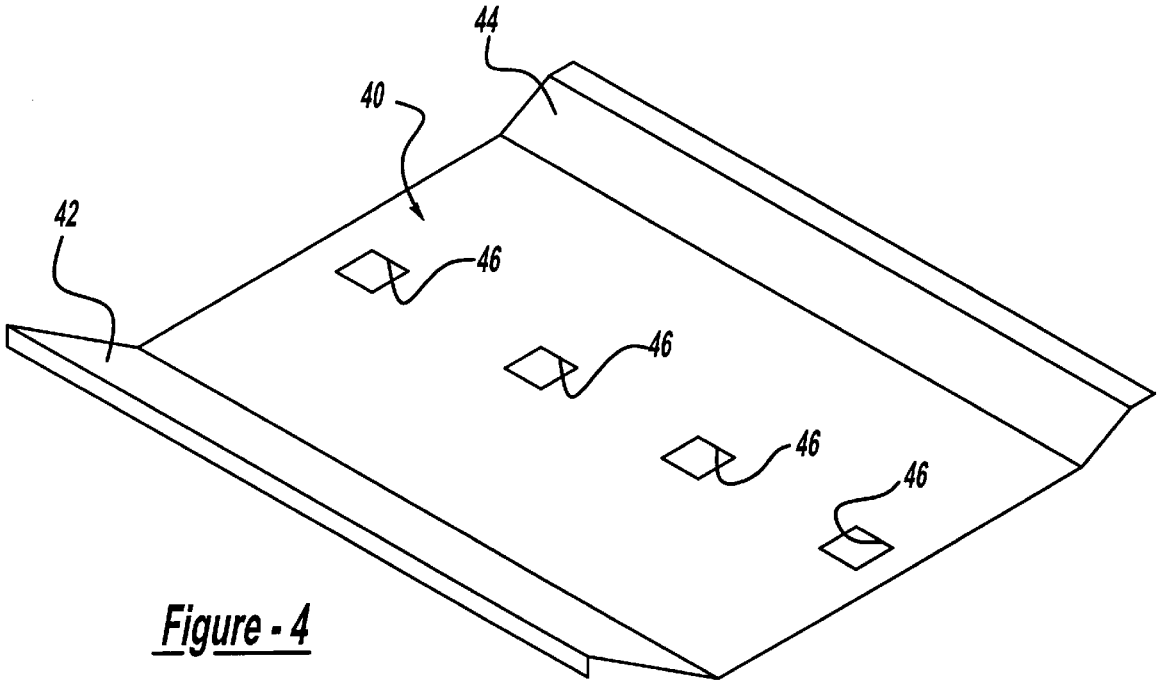
FIG. 4 is a perspective view of the spring clip member of FIGS. 1 and 2.

FIGS. 1 through 17 illustrate various embodiments of a coping assembly according to the present invention, shown merely for purposes of illustration as installed on various configurations of parapet walls, cant dams, or gravel stops. One skilled in the art will readily recognize, however, that the principles of the present invention are equally applicable to other coping assemblies having lateral cross-sections varying from those shown for purposes of illustration in the drawings, as well as for installation on other configurations of raised protrusions extending generally upwardly from any portion of the roof of a building.

FIGS. 1 through 4 illustrate one preferred embodiment of a coping assembly 10, shown merely for purposes of illustration as installed upon a parapet wall 12 such as that frequently found running along or adjacent to the edge of a building roof, as well as on other inboard roof areas. The parapet wall 12 includes a parapet upper surface 14, a parapet outer face 16, and a parapet inner face 18. It should be noted that the designations "outer" and "inner" are used herein are for convenience of reference to the drawing figures and do not necessarily refer to the side of a structure or component oriented toward the outer or inner portions, respectively, of the building roof.

A coping cleat 20 is adapted for being fixedly secured to the parapet wall 12, or other such raised protrusion, extending longitudinally along the roof of a building. The coping cleat 20 includes an upper cleat portion 22 extending generally horizontally in this embodiment across the generally horizontal illustrative parapet upper surface 14. An outer cleat portion 24 extends generally downwardly along or adjacent to the parapet outer face 16 on one side of the upper cleat portion 22, and an inner cleat portion 26 extends generally downwardly from an opposite side of the upper cleat portion 22 along or adjacent to the parapet inner face 18.

A coping cap 30 is interlockingly installed upon the coping cleat 20, preferably in a snap-on engagement therewith by way of its generally hook-shaped outer and inner cap edges 35 and 37 in snap-on engagement with respective outer and inner cleat edges 27 and 28. The coping cap 30 includes an upper cap portion 32, an outer cap portion 34 extending generally downwardly from one side of the upper cap portion 32, and an inner cap portion 36 extending generally downwardly from an opposite or inner side of the upper cap portion 32. In the particular embodiment illustrated in FIGS. 1 through 4, the outer cap portion 34 is fabricated in a generally semi-circular or "bullnose" configuration. It should be noted that other shapes can be used in the present invention and that such bullnose or other cross-sectional shapes can be used on either or both of the outer and inner sides of the assembly.

A spring clip 40 is secured to the coping cleat 20 and includes one or more of the resilient spring clip protrusions 42 and 44 resiliently engaging respective portions of the underside of the coping cap 30. The spring clip 40 is preferably secured to the coping cleat 20 by way of a number of cleat tabs 23 spaced longitudinally along the upper cleat portion 22 with each of the cleat tabs 23 extending through corresponding longitudinally spaced-apart spring clip openings 46 in order to tightly engage and secure the spring clip 40. It should be noted though that other fastening arrangements can alternatively be used to secure the spring clip 40 to the coping cleat 20. The arrangement depicted in FIGS. 1 through 4, however, is believed to be highly advantageous in terms of speed, ease, and economy of installation.

A coping locator member 50, which is preferably symmetrical with respect to a line 51 normal to the face of the parapet wall 12, is of a generally triangular lateral cross-sectional shape in the embodiment of FIGS. 1 through 4, with a locator apex 52 between two equal-length locator sides 54. In the embodiment of FIGS. 1 through 4, the coping locator 50 is preferably secured to the face of the coping cleat 20 by way of spaced-apart, oppositely-facing outer cleat tabs 25. In this configuration, which is believed to result in quick, easy, and economical installation, the locator sides 54 are merely squeezed toward one another until respective locator flanges 56 can clear the cleat tabs 25, whereupon the locator sides 54 are released such that the locator flanges are captured and secured by the cleat tabs 25, providing a tight, rattle-free securement. The preferred generally symmetrical configuration of the coping locator 50 also maintains the illustrative bullnose outer cap portion 34 in a uniform predetermined lateral cross-sectional shape and at a predetermined spacing from the face of the parapet wall 12.

As mentioned above, the coping assembly 10 is typically fabricated in longitudinal sections of a predetermined length. In order to provide the above-mentioned advantages of the invention in installations requiring more than one coping cap sections, a joint cover 60, illustrated in FIG. 1, is provided to bridge the longitudinal abutment of adjacent coping cap sections. The joint cover 60 preferably includes an upperjoint cover portion 62, an outer joint cover portion 64, and an inner joint cover portion 66. In its preferred form, the joint cover 60 has substantially the same lateral cross-sectional shape as the coping cap 30, but sized slightly smaller so it can be disposed between the coping cap 30 and the coping cleat 20, as well as between the coping cap 30 and the spring clip 40. Perhaps even more importantly, though, such complementary cross-sectional shape of the joint cover 60 and the coping cap 30 allows the joint cover 60 to also be disposed between the coping cap 30 and the coping locator 50, thus substantially assuring proper alignment between adjacent coping cap sections, as well as providing structural support for the abutting joint and maintenance of the desired lateral cross-sectional shape. In all of the embodiments discussed herein, tab-type securements, driven or threaded fastener securements, and welding securements are interchangeable with one another.

As mentioned above, FIGS. 5 through 10 illustrate a number of alternative embodiments of the present invention, wherein identical, similar or corresponding components are indicated by reference numerals corresponding to those of FIGS. 1 through 4 but having respective reference numeral prefixes ranging from one-hundred to six-hundred in FIGS. 5 through 10. In most if not all respects, however, such correspondingly-numbered elements perform substantially the same, or at least similar, functions as those of FIGS. 1 through 4.

Figure 5:
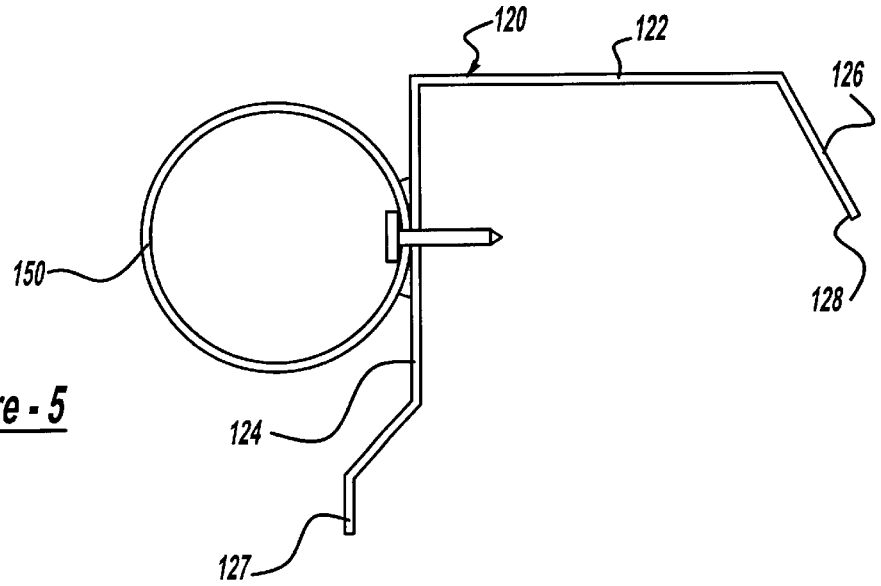
FIGS. 5 through 10 are illustrative diagrammatic lateral cross-sectional views of various alternative embodiments of a coping assembly according to the present invention, all of which can to be used in conjunction with a coping cap of the same or similar general configuration as that of FIGS. 1 and 2.

FIG. 5 diagrammatically illustrates only the coping cleat 120 and the coping locator 150, and is adapted for use in conjunction with coping caps and coping covers similar or identical to those of FIGS. 1 through 4. In FIG. 5, the generally triangular-shaped coping locator 50 is replaced by a generally cylindrical, but still symmetrical, coping locator 150 secured to the outer cleat portion 124.

Figure 6:
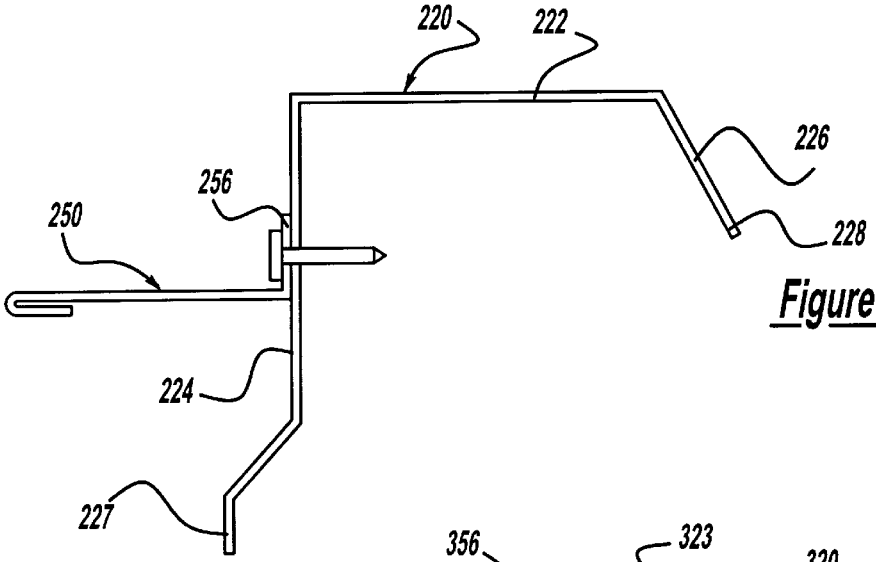

In FIG. 6, an alternative coping locator 250 is shown installed on a coping cleat 220 by way of a nail or threaded fastener extending through the locator flange 256 and through the outer cleat portion 224. It should be noted that the outer end of the coping locator 250 is folded over merely for purposes of keeping its outer end from abrading or otherwise damaging the coping cap 230. In terms of its structural support and its capabilities of maintaining the coping cap in a predetermined cross-sectional shape, the outwardly-protruding portion of the coping cap locator 250 is considered to be substantially symmetrical with respect to a line normal to the outer face of the outer cleat portion 224.

Figure 7:
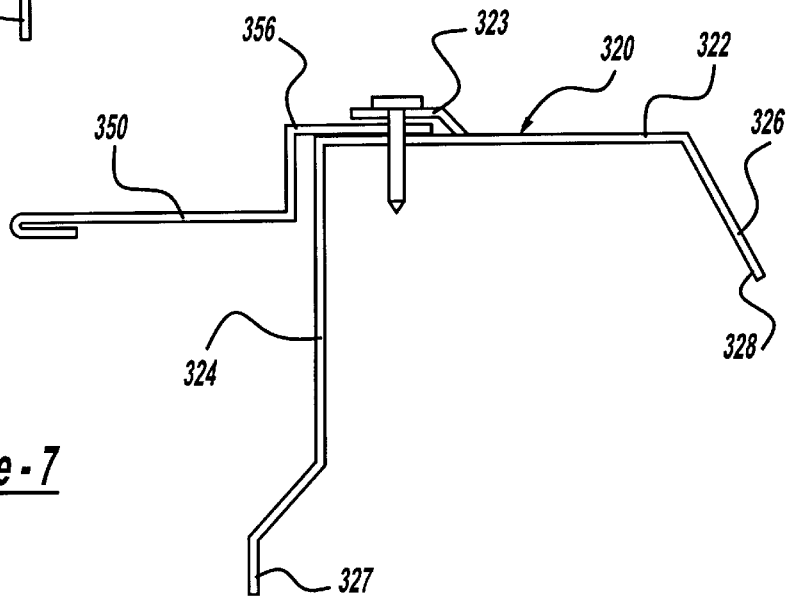

FIG. 7 illustrates yet another embodiment, similar to that of FIG. 6, except that the coping locator 350 is secured to the coping cleat 320 by way of a locator flange 356 which can be captured and secured by an upper cleat tab 323 and/or a driven or threaded fastener or even by welding methods, such as TIG, MIG, or spot welding. It should further be noted that in any of the alternate embodiments of FIGS. 5 through 10, such a cleat tab securing arrangement can be provided and/or a driven or threaded fastener can be used.

Figure 8:
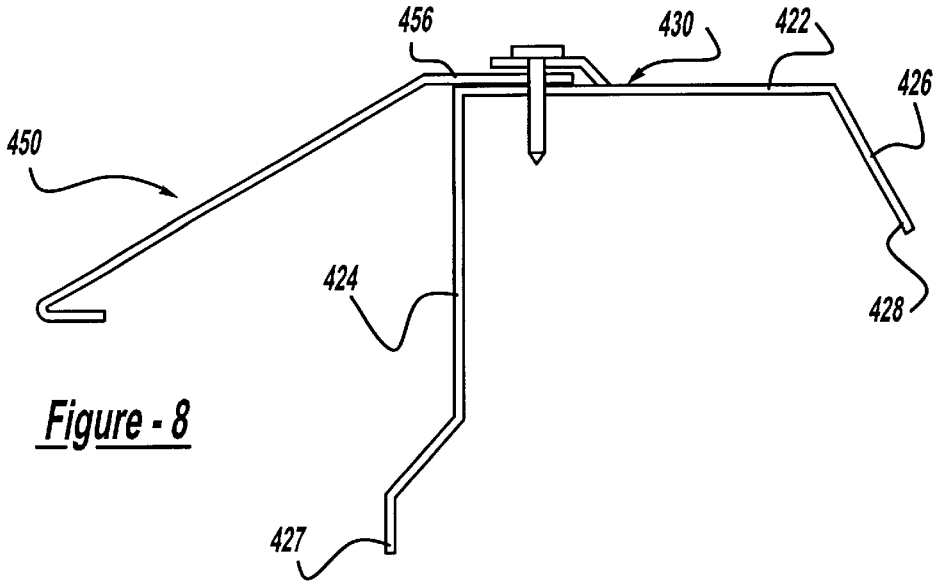

FIG. 8 illustrates an arrangement similar to that of the alternative embodiment of FIG. 7, except that the outwardly-protruding portion of the coping locator 450 extends generally outwardly and downwardly with respect to the outer cleat portion 424 of the coping cleat 420. This arrangement is especially well-suited for installations where greater coping locator lateral flexibility may be deemed to be advantageous or desired.

Figure 9:
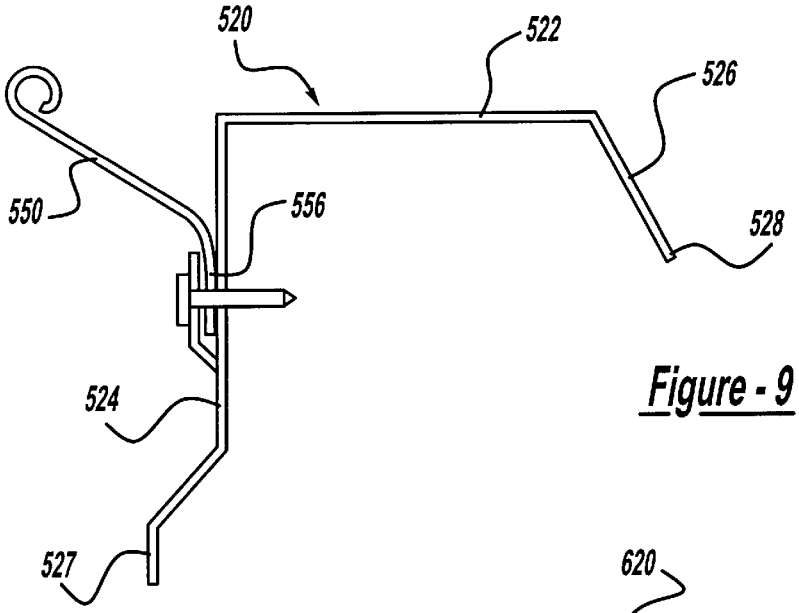

FIG. 9 illustrates a coping locator 550 similar to that of FIG. 8, but with its outwardly-protruding portion extending generally outwardly and upwardly from the outer cleat portion 524 of the coping cleat 520.

Figure 10:
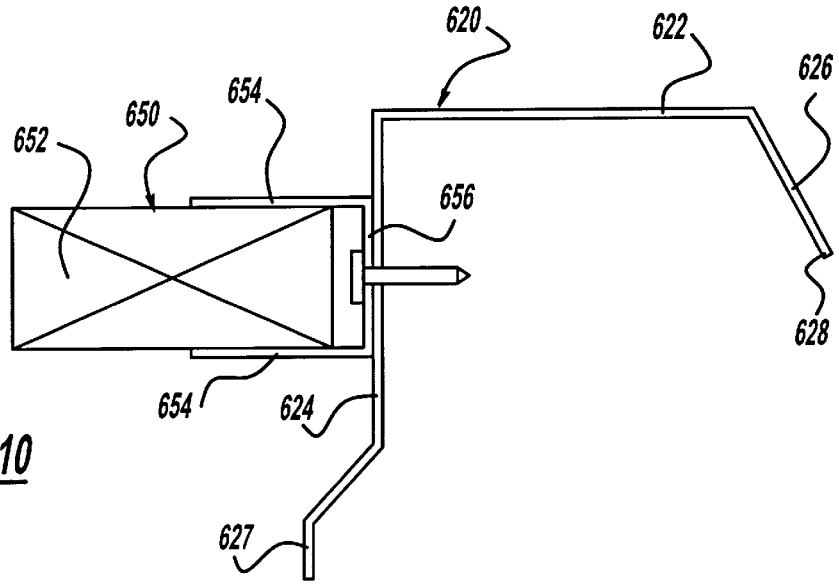

In FIG. 10, still another alternate arrangement includes a symmetrical coping locator assembly 650, having a two-piece configuration. In FIG. 10, the outwardly-protruding portion of the coping locator assembly 650 is composed of wood or other suitable building material and is grippingly secured in place by a pair of spaced-apart coping locator sides 654 that extend horizontally outwardly from a coping locator flange portion 656.

Figure 11:
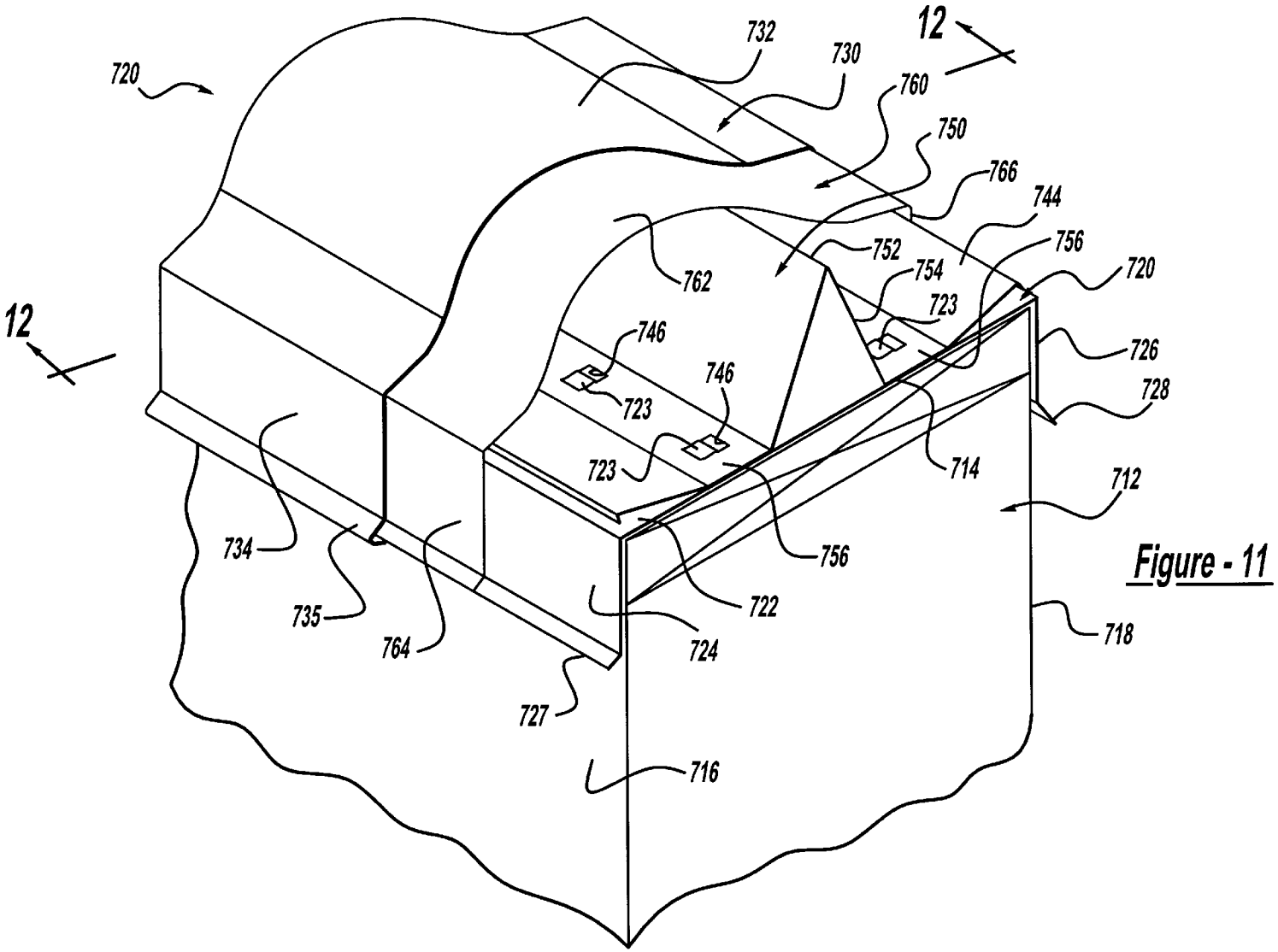
FIG. 11 illustrates yet another alternative embodiment of a coping assembly according to the present invention, shown in a partial, detailed perspective view similar to that of FIG. 1.
Figure 12:
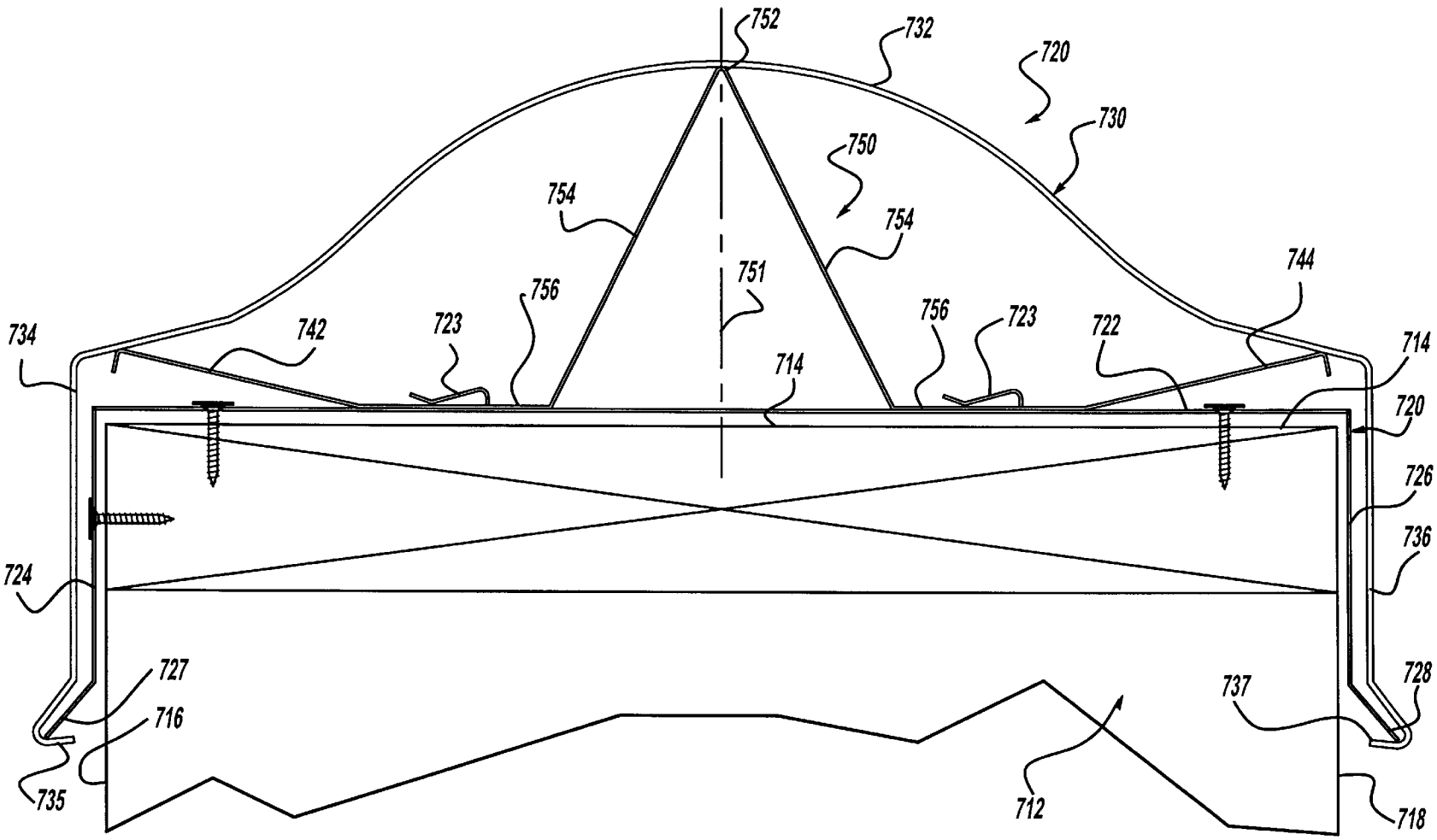
FIG. 12 is a lateral cross-sectional view, taken generally along line 12–12 of FIG. 11.
Figure 13:
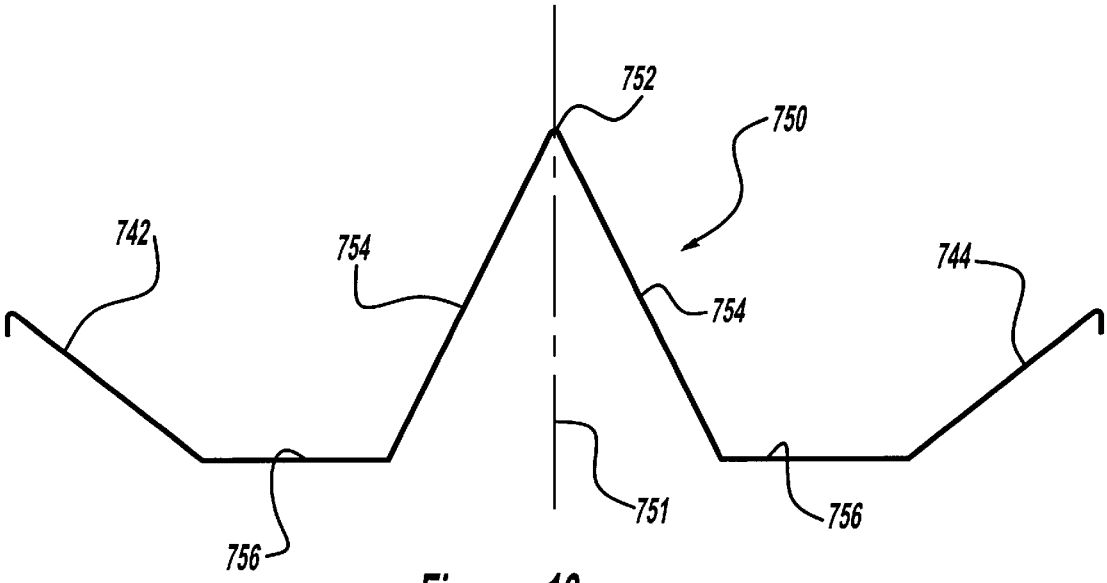
FIG. 13 is a lateral cross-sectional view of the combination spring clip and cap locator member of FIGS. 11 and 12.

FIGS. 11 through 13 illustrate a somewhat more diverse alternate embodiment of the resent invention, having a coping assembly 720 that includes a coping cap 730 that straddles and overlies the outer and inner sides 724 and 726, respectively, of the coping cleat 720. The upper coping cap portion 732 is generally "peaked" or "humped" in lateral cross-sectional shape. In this embodiment, a pair of oppositely-facing sloped resilient spring protrusions 742 and 744 are incorporated into the coping locator 750 and resiliently engage the undersides of the coping cap 730 and the joint cover 760 at the abutment of longitudinally adjacent coping cap sections. The coping locator 750 is secured to the coping cleat 720 and is symmetrical with respect to a line 751 extending in a normal direction with respect to the upper parapet surface 714 of the parapet wall 712. Thus, in the embodiment illustrated in FIG. 11 through 13, the coping locator 750 also has a locator apex 752 that engages the undersides of both the coping cap 730 and the joint cover 760 in order to maintain the above-discussed predetermined cross-sectional shape, vertical spacing from the parapet wall 712, as well as the proper alignment between longitudinally-adjacent coping cap sections.

Figure 14:
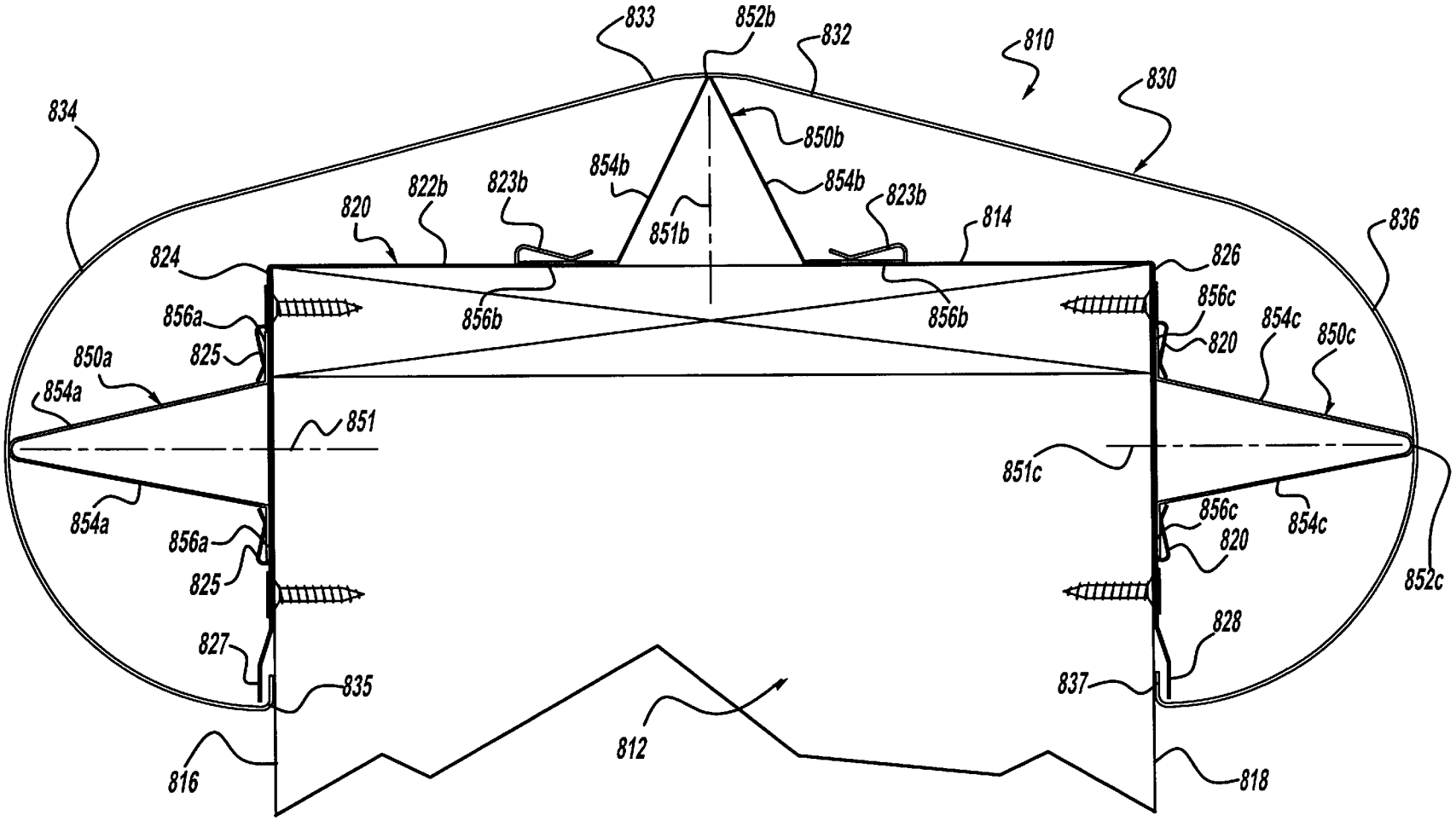
FIGS. 14 through 17 are lateral cross-sectional views, somewhat similar to that of FIG. 12, but illustrating still further alternate embodiments of the present invention.

FIG. 14 illustrates yet another alternate embodiment of the present invention, generally similar to that of FIGS. 11 through 13, except that three coping locators 850*a*, 850*b*, and 850*c*, are provided for engagement with the undersides of the coping cap 830 and its complementary and associated joint cover (not shown).

Figure 15:
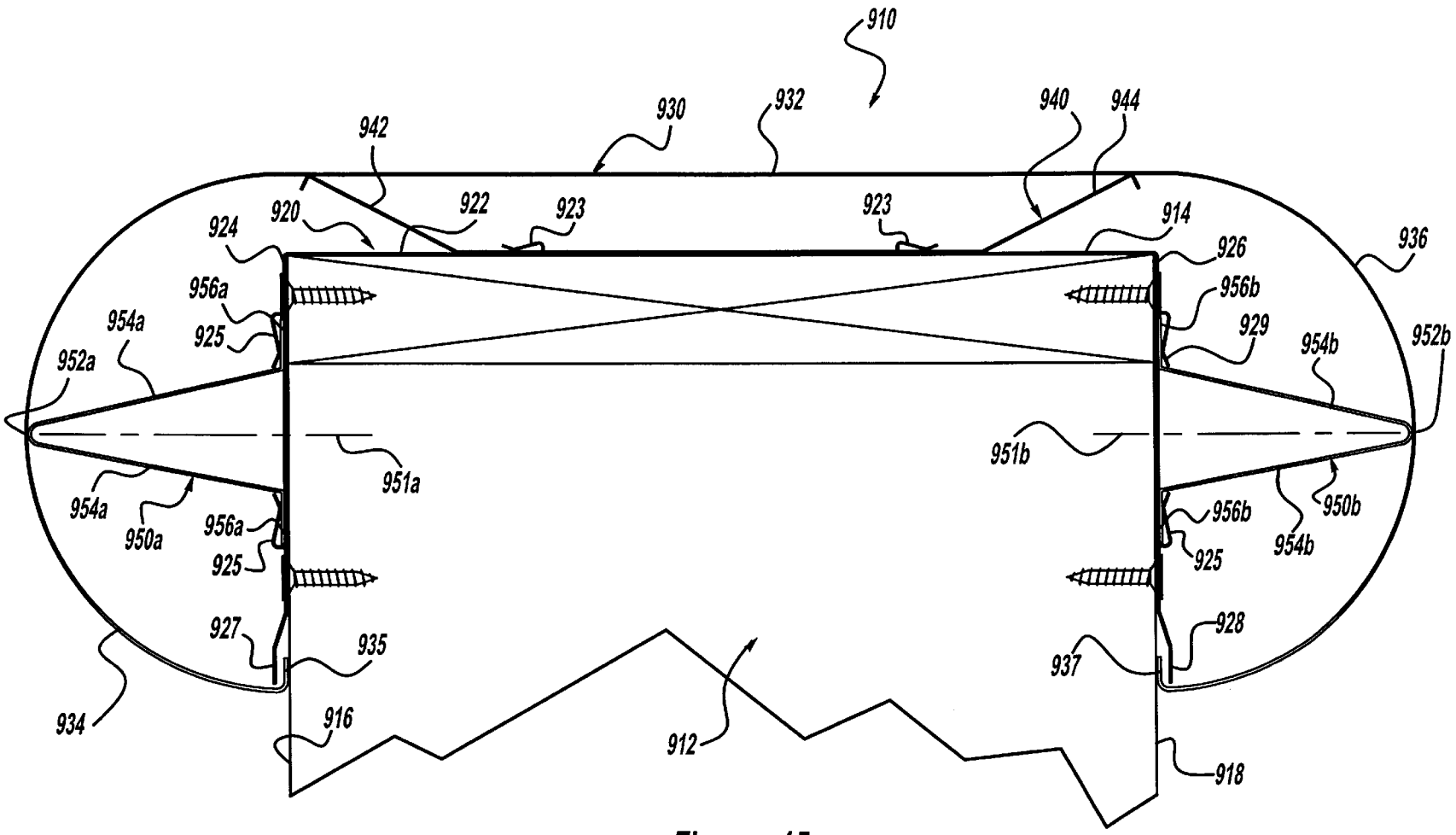

In FIG. 15, still another alternate embodiment is somewhat similar to that of FIG. 14, except that the peaked upper portion of the coping cap 830 is eliminated and replaced by a generally horizontal and generally flat upper cap portion 932. Thus, only the two coping locators 950*a* and 950*b* are typically required. It should be noted, however, that a third coping locator could alternatively be provided on the upper cleat portion 922 for engagement with the underside of the upper cap portion 932 and the complementary joint cover (not shown).

Figure 16:
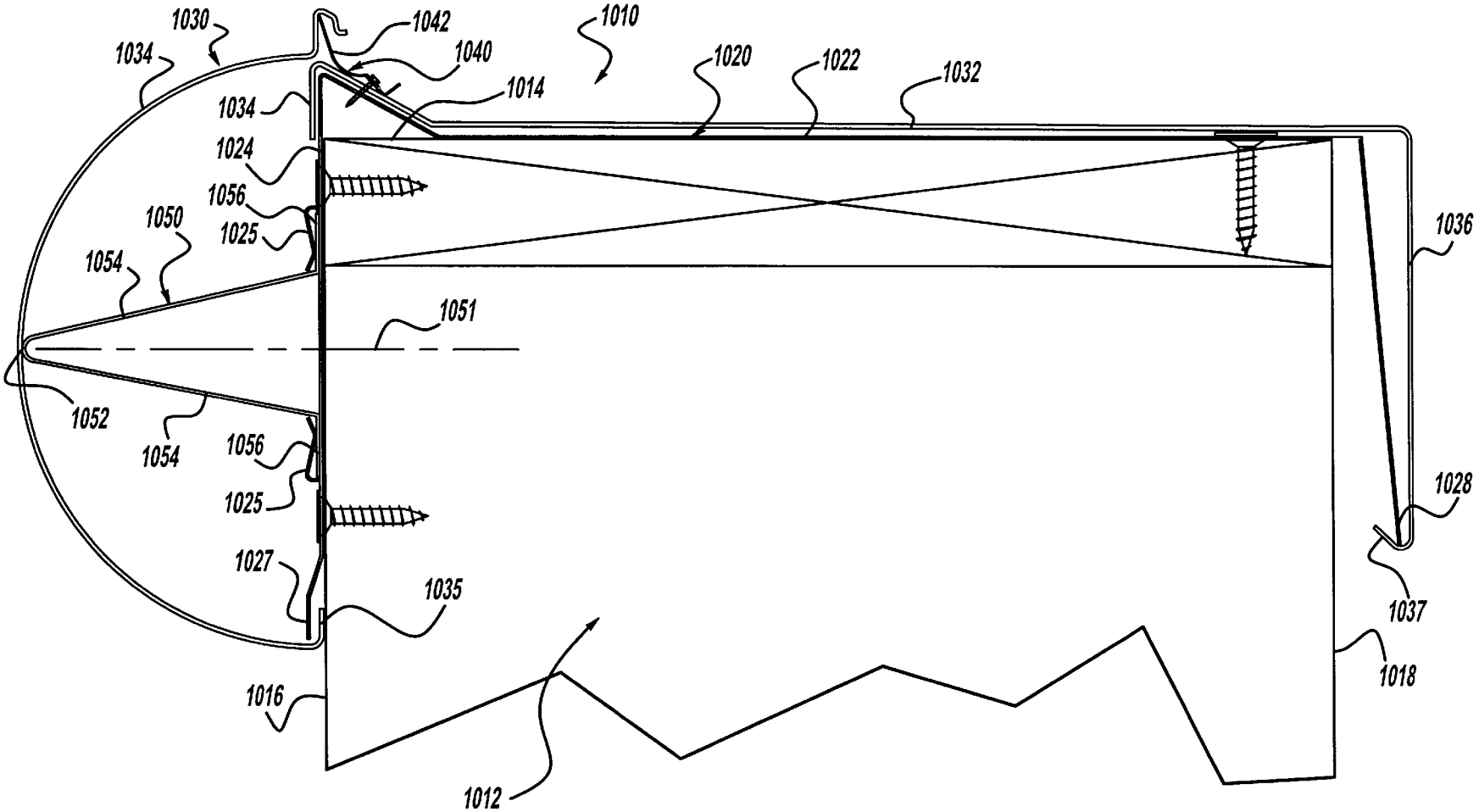

In FIG. 16, another somewhat diverse alternate embodiment of the present invention is illustrated with the coping cap 1030 being formed in a two-piece assembly separated generally between the outer cap portion 1034 and the upper cap portion 1032. In addition, the coping cleat 1020 is formed of a configuration having a gravel stop or cant dam configuration with the upper cleat portion 1022 having an upwardly and outwardly sloped portion extending toward the outer cleat portion 1024. In this embodiment, a somewhat different spring clip 1040 is secured to such upwardly and outwardly sloping portion of the coping cleat 1020 as well as to a similarly upwardly and outwardly sloping portion of the upper cap portion 1032 of the coping cap assembly 1030. Such securement of the spring clip 1040 can be accomplished by way of threaded fasteners, as illustrated in FIG. 16, or by way of gripping tabs on the coping cap 1030 and/or on the coping cleat 1020, with the tabs extending through spaced-apart openings in the spring clip 1040, similar to those discussed above in connection with previously-described embodiments.

Figure 17:
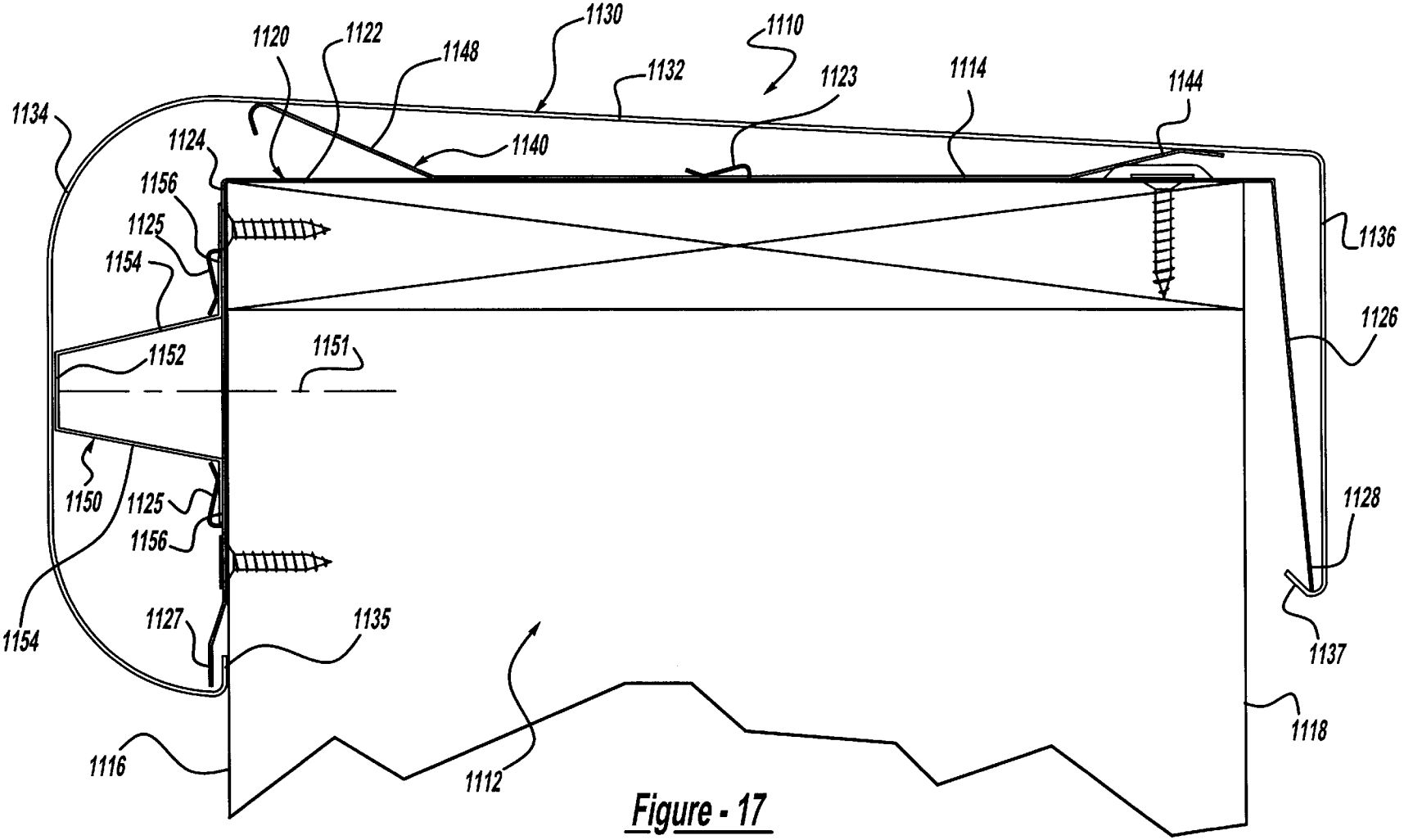

Finally, FIG. 17 illustrates still another alternate embodiment of the present invention, wherein the outer cap portion 1134 of the coping cap 1130 has a generally vertically-extending flat portion. In such an embodiment, the symmetrical coping locator has a correspondingly generally flat outer locator "apex-like" portion 1152 between the locator sides 1154. In other respects, the elements of this and the previously-discussed alternate embodiments are generally similar in configuration and/or function to the elements depicted in the first-discussed embodiment of FIGS. 1 through 4.

As mentioned above, in all embodiments the tab-type securements and the driven or threaded fastener securements described herein are generally interchangeable with each other, or with various welding securements (e.g., TIG, MIG, or spot welding), as well as with other fastening means known to those skilled in the art.

The foregoing discussion discloses and describes merely exemplary embodiments of the present invention for purposes of illustration only. The various illustrative alternate embodiments depicted and described herein demonstrate the flexibility of the applicability of the present invention to widely diverse installations. One skilled in the art will readily recognize from such discussion, and from the accompanying drawings and claims, that various changes, modifications, and variations can be made therein without departing from the spirit and scope of the invention as defined in the following claims.

What is claimed is:

1. A coping for a raised protrusion protruding generally upwardly from a surface, the raised protrusion extending in a longitudinal direction and having a protrusion upper surface, a protrusion outer face extending generally downwardly from one side of the protrusion upper surface, and a protrusion inner face extending generally downwardly from an opposite side of the protrusion upper surface, said coping comprising:

a coping cleat for fixed securement to the raised protrusion, said cleat having an upper cleat portion extending along the protrusion upper surface, an outer cleat portion extending generally downwardly along the protrusion outer face from an outer side of said upper cleat portion, and an inner cleat portion extending generally downwardly along the protrusion inner face from an opposite inner side of said upper cleat portion;

a coping cap having an upper cap portion, an outer cap portion extending generally downwardly from an outer side of said upper cap portion, and an inner cap portion extending generally downwardly from an opposite inner side of said upper cap portion, said outer and inner cap portions having edges secured to said respective outer and inner cleat portions;

a spring clip secured to said coping cleat and disposed between said coping cleat and said coping cap, said spring clip having at least one resilient spring clip protrusion resiliently engaging a first portion of an underside of said coping cap; and a coping locator secured to said coping cleat and disposed between said coping cleat and said coping cap, said locator protruding from said coping cleat and engaging a second portion of said underside of said coping cap in order to space said second portion of said underside of said coping cap a predetermined generally fixed distance from said coping cleat, said locator also maintaining at least a portion of said coping cap in a predetermined cross-sectional shape.

2. A coping according to claim 1, wherein said coping cap is formed in cap sections of a predetermined longitudinal length, said cap sections serially abuttingly engaging one another and extending along the raised protrusion, said coping further including a joint cover disposed between said underside of adjacent coping cap sections and said coping locator at said abutting engagement of said adjacent coping cap sections in order to maintain alignment of said adjacent coping cap sections at said abutting engagement.

3. A coping according to claim 2, wherein said joint cover and said coping cap have substantially the same cross-sectional shape.

4. A coping according to claim 2, wherein said joint cover also extends between said underside of said coping cap and said resilient spring clip protrusion.

5. A coping according to claim 4, wherein said joint cover and said coping cap have substantially the same cross-sectional shape.

6. A coping according to claim 1, wherein said coping locator protrudes from said outer cleat portion to engage said underside of said outer coping cap portion.

7. A coping according to claim 1, wherein said coping locator protrudes from said upper cleat portion to engage said underside of said upper coping cap portion.

8. A coping according to claim 1, further including a pair of said coping locators, an outer of said coping locators protruding from said outer cleat portion and an inner of said coping locators protruding from said inner cleat portion to engage respective undersides of said outer and inner coping cap portions.

9. A coping according to claim 1, wherein said spring clip has a number of openings spaced longitudinally therealong, said coping cleat having a corresponding number of cleat tabs spaced longitudinally therealong, each of said cleat tabs protruding through one of said spring clip openings and engaging said spring clip in order to secure said spring clip to said coping cleat.

10. A coping according to claim 1, wherein said coping locator has a flange extending longitudinally along at least one edge, said coping cleat having a number of cleat tabs spaced longitudinally therealong, said cleat tabs engaging said coping locator flange in order to secure said coping locator to said coping cleat.

11. A coping according to claim 1, wherein said spring clip has a pair of said resilient spring clip protrusions spaced laterally apart from each other and resiliently engaging said underside of said coping cap.

12. A coping according to claim 11, wherein said spring clip is secured to said upper cleat portion, said resilient spring clip protrusion resiliently engaging said underside of said upper cap upper portion.

13. A coping according to claim 1, wherein the raised protusion outer face and said outer cleat portion both extend generally vertically downwardly.

14. A coping according to claim 1, wherein at least a portion of said upper cleat portion slopes generally in an outward and upward direction relative to said respective raised protrusion upper surface.

15. A coping according to claim 1, wherein said raised protrusion upper surface and said upper cleat portion both extend generally horizontally.

16. A coping according to claim 1, wherein at least part of said upper cap portion is peaked upwardly.

17. A coping according to claim 1, wherein said coping locator is symmetrical about a horizontal line normal to the raised protrusion outer face.

18. A coping according to claim 17, wherein said coping locator has a generally triangular lateral cross-sectional shape, said normal horizontal line extending through an apex between two equal sides of said triangular cross-sectional shape.

19. A coping according to claim 1, wherein said coping locator is symmetrical about a vertical line normal to the raised protrusion upper surface.

20. A coping according to claim 19, wherein said coping locator has a generally triangular lateral cross-sectional shape, said normal vertical line extending through an apex between two equal sides of said triangular cross-sectional shape.

21. A coping according to claim 1, wherein said coping cap outer and inner cap portions have generally hook-shaped edge portions thereon for snap-on engagement with respective outer and inner cleat portion edges.

22. A coping according to claim 1, wherein the raised protrusion is a free-standing wall.

23. A coping according to claim 1, wherein the raised protrusion protrudes upwardly from a building roof.

24. A coping according to claim 1, wherein the raised protrusion is a parapet wall on a building roof.

25. A coping for a raised parapet wall protruding generally upwardly from a roof on a building, the raised parapet wall extending in a longitudinal direction along the roof and having a generally horizontal wall upper surface, a generally vertical wall outer face extending downwardly from one side of the wall upper surface, and a generally vertical wall inner face extending downwardly from an opposite side of the wall upper surface, said coping comprising:

a coping cleat for fixed securement to the raised parapet wall, said cleat having an upper cleat portion extending along the wall upper surface, an outer cleat portion extending downwardly along the wall outer face from an outer side of said upper cleat portion, and an inner cleat portion extending downwardly along the wall inner face from an opposite inner side of said upper cleat portion;

a coping cap having an upper cap portion, an outer cap portion extending generally downwardly from an outer side of said upper cap portion, and an inner cap portion extending generally downwardly from an opposite inner side of said upper cap portion, said outer and inner cap portions having edges secured to said respective outer and inner cleat portions;

a spring clip secured to said coping cleat and disposed between said coping cleat and said coping cap, said spring clip having at least one resilient spring clip protrusion resiliently engaging a first portion of an underside of said coping cap; and a coping locator secured to said coping cleat and disposed between said coping cleat and said coping cap, said locator protruding from said coping cleat and engaging a second portion of said underside of said coping cap in order to space said second portion of said underside of said coping cap a predetermined generally fixed distance from said coping cleat, said locator also maintaining at least a portion of said coping cap in a predetermined cross-sectional shape.

26. A coping according to claim 25, wherein said coping cap is formed in cap sections of a predetermined longitudinal length, said cap sections serially abuttingly engaging one another and extending along the raised protrusion, said coping further including a joint cover disposed between said underside of adjacent coping cap sections and said coping locator at said abutting engagement of said adjacent coping cap sections in order to maintain alignment of said adjacent coping cap sections at said abutting engagement.

27. A coping according to claim 26, wherein said joint cover and said coping cap have substantially the same cross-sectional shape.

28. A coping according to claim 26, wherein said joint cover also extends between said underside of said coping cap and said resilient spring clip protrusion.

29. A coping according to claim 28, wherein said joint cover and said coping cap have substantially the same cross-sectional shape.

30. A coping according to claim 25, wherein said coping locator protrudes from said outer cleat portion to engage said underside of said outer coping cap portion.

31. A coping according to claim 25, wherein said coping locator protrudes from said upper cleat portion to engage said underside of said upper coping cap portion.

32. A coping according to claim 25, further including a pair of said coping locators, an outer of said coping locators protruding from said outer cleat portion and an inner of said coping locators protruding from said inner cleat portion to engage respective undersides of said outer and inner coping cap portions.

33. A coping according to claim 25, wherein said spring clip has a number of openings spaced longitudinally therealong, said coping cleat having a corresponding number of cleat tabs spaced longitudinally therealong, each of said cleat tabs protruding through one of said spring clip openings and engaging said spring clip in order to secure said spring clip to said coping cleat.

34. A coping according to claim 25, wherein said coping locator has a flange extending longitudinally along at least one edge, said coping cleat having a number of cleat tabs spaced longitudinally therealong, said cleat tabs engaging said coping locator flange in order to secure said coping locator to said coping cleat.

35. A coping according to claim 25, wherein said spring clip has a pair of said resilient spring clip protrusions spaced laterally apart from each other and resiliently engaging said underside of said coping cap.

36. A coping according to claim 35, wherein said spring clip is secured to said upper cleat portion, said resilient spring clip protrusion resiliently engaging said underside of said upper cap upper portion.

37. A coping according to claim 25, wherein said raised parapet wall upper surface and said upper cleat portion both extend generally horizontally.

38. A coping according to claim 25, wherein at least part of said upper cap portion is peaked upwardly.

39. A coping according to claim 25, wherein said coping locator is symmetrical about a horizontal line normal to the raised parapet wall outer face.

40. A coping according to claim 39, wherein said coping locator has a generally triangular lateral cross-sectional shape, said normal horizontal line extending through an apex between two equal sides of said triangular cross-sectional shape.

41. A coping according to claim 25, wherein said coping locator is symmetrical about a vertical line normal to the raised parapet wall upper surface.

42. A coping according to claim 41, wherein said coping locator has a generally triangular lateral cross-sectional shape, said normal vertical line extending through an apex between two equal sides of said triangular cross-sectional shape.

43. A coping according to claim 25, wherein said coping cap outer and inner cap portions have generally hook-shaped edge portions thereon for snap-on engagement with respective outer and inner cleat portion edges.

44. A coping for a gravel stop protruding generally upwardly from a roof on a building, the gravel stop extending in a longitudinal direction along the roof and having a gravel stop upper surface, a gravel stop outer face extending generally downwardly from one side of the protrusion upper surface, and a gravel stop inner face sloping generally downwardly and inwardly from an opposite side of the gravel stop upper surface, said coping comprising:

a coping cleat for fixed securement to the gravel stop, said cleat having an upper cleat portion extending along the gravel stop upper surface, an outer cleat portion extending generally downwardly along the gravel stop outer face from an outer side of said upper cleat portion, and an inner cleat portion extending generally downwardly and inwardly along the gravel stop inner face from an opposite inner side of said upper cleat portion;

a coping cap having an upper cap portion, an outer cap portion extending generally downwardly from an outer side of said upper cap portion, and an inner cap portion extending generally downwardly and inwardly from an opposite inner side of said upper cap portion, said outer and inner cap portions having edges secured to said respective outer and inner cleat portions;

a spring clip secured to said coping cleat and disposed between said coping cleat and said coping cap, said spring clip having at least one resilient spring clip protrusion resiliently engaging a first portion of an underside of said coping cap; and a coping locator secured to said coping cleat outer portion and disposed between said coping cleat and said coping cap, said locator protruding generally horizontally from said coping cleat and engaging an underside of said coping cap outer portion in order to space said underside of said coping cap outer portion a predetermined generally fixed distance from said coping cleat outer portion, said locator also maintaining said coping cap outer portion in a predetermined cross-sectional shape.

45. A coping according to claim 44, wherein said coping cap is formed in cap sections of a predetermined longitudinal length, said cap sections serially abuttingly engaging one another and extending along the parapet wall, said coping further including a joint cover disposed between said underside of adjacent coping cap sections and said coping locator at said abutting engagement of said adjacent coping cap sections in order to maintain alignment of said adjacent coping cap sections at said abutting engagement.

46. A coping according to claim 45, wherein said joint cover and said coping cap have substantially the same cross-sectional shape.

47. A coping according to claim 45, wherein said joint cover also extends between said underside of said coping cap and said resilient spring clip protrusion.

48. A coping according to claim 47, wherein said joint cover and said coping cap have substantially the same cross-sectional shape.

49. A coping according to claim 44, wherein said spring clip has a number of openings spaced longitudinally therealong, said coping cleat having a corresponding number of cleat tabs spaced longitudinally therealong, each of said cleat tabs protruding through one of said spring clip openings and engaging said spring clip in order to secure said spring clip to said coping cleat.

50. A coping according to claim 44, wherein said coping locator has a flange extending longitudinally along at least one edge, said coping cleat having a number of cleat tabs spaced longitudinally therealong, said cleat tabs engaging said coping locator flange in order to secure said coping locator to said coping cleat.

51. A coping according to claim 44, wherein said coping locator is symmetrical about a horizontal line normal to the parapet wall outer face.

52. A coping according to claim 51, wherein said coping locator has a generally triangular lateral cross-sectional shape, said normal horizontal line extending through an apex between two equal sides of said triangular cross-sectional shape.

53. A coping according to claim 44, wherein said coping cap outer and inner cap portions have generally hook-shaped edge portions thereon for snap-on engagement with respective outer and inner cleat portion edges.

* * * * *